US010212526B2

(12) United States Patent
Wendell et al.

(10) Patent No.: US 10,212,526 B2
(45) Date of Patent: Feb. 19, 2019

(54) ACOUSTIC PRESSURE REDUCER AND ENGINEERED LEAK

(71) Applicant: BOSE CORPORATION, Framingham, MA (US)

(72) Inventors: John Harlan Wendell, Boston, MA (US); Randy Michael Carbo, Hopedale, MA (US); Eric Carl Mitchell, Upton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/405,788

(22) Filed: Jan. 13, 2017

(65) Prior Publication Data

US 2018/0206049 A1 Jul. 19, 2018

(51) Int. Cl.
*H04R 29/00* (2006.01)
*H04R 3/00* (2006.01)
(Continued)

(52) U.S. Cl.
CPC ..... *H04R 29/001* (2013.01); *H04R 1/025* (2013.01); *H04R 1/28* (2013.01); *H04R 3/007* (2013.01);
(Continued)

(58) Field of Classification Search
CPC ..... H04R 3/04; H04R 29/001; H04R 1/025; H04R 19/04; H04R 2201/003; H04R 2430/01; H04R 1/28; H04R 3/007
(Continued)

(56) References Cited

U.S. PATENT DOCUMENTS

2003/0095672 A1* 5/2003 Hobelsberger ..... F16L 55/0333 381/96
2003/0210798 A1* 11/2003 Ohyaba ..... H04R 3/002 381/96
(Continued)

FOREIGN PATENT DOCUMENTS

EP 2879404 A1 6/2015
EP 2966878 A1 1/2016
(Continued)

OTHER PUBLICATIONS

"Acoustic Impedance Measurements", Chapter 6, pp. 7-9, retrieved from the Internet: <http://pcfarina.eng.unipr.it/Public/Standing-Wave/ebook_6_impedance.pdf> on [Apr. 26, 2018].
(Continued)

*Primary Examiner* — Paul Kim
*Assistant Examiner* — Ubachukwu A Odunukwe
(74) *Attorney, Agent, or Firm* — Lando & Anastasi, LLP

(57) ABSTRACT

An acoustic pressure reducer acoustically couples to and provides acoustic impedance to attenuate the acoustic box pressure of an acoustic system, such as a loudspeaker system. The pressure reducer may also allow an ambient pressure of the acoustic system to equalize with an ambient pressure of an external environment and the ambient pressure of the acoustic pressure reducer at a certain rate. The attenuation may allow for inexpensive acoustic sensors to be utilized within the pressure reducer to measure one or more acoustic properties of an attenuated acoustic pressure within the pressure reducer. An unattenuated acoustic pressure value of the acoustic system may be estimated using a known transfer function of the pressure reducer and the attenuated acoustic pressure values measured within. A controller coupled to the acoustic system may adjust one or
(Continued)

more operating characteristics in response to estimating the unattenuated acoustic pressure.

17 Claims, 11 Drawing Sheets

(51) Int. Cl.
*H04R 1/02* (2006.01)
*H04R 19/04* (2006.01)
*H04R 3/04* (2006.01)
*H04R 1/28* (2006.01)

(52) U.S. Cl.
CPC ..... *H04R 3/04* (2013.01); *H04R 19/04* (2013.01); *H04R 2201/003* (2013.01); *H04R 2430/01* (2013.01)

(58) Field of Classification Search
USPC ..... 381/59, 58, 66, 96
See application file for complete search history.

(56) References Cited

U.S. PATENT DOCUMENTS

2004/0184623 A1* 9/2004 Johannsen ..... H04R 3/002 381/117
2013/0019661 A1* 1/2013 Choi ..... G01N 11/16 73/54.41
2015/0156580 A1* 6/2015 Van Schyndel ..... G10K 11/16 381/66
2018/0091910 A1* 3/2018 Porter ..... H04R 29/001

FOREIGN PATENT DOCUMENTS

EP 3099047 A1 11/2016
GB 2527784 A 1/2016

OTHER PUBLICATIONS

International Search Report and Written Opinion in application No. PCT/US2018/013135 dated Apr. 26, 2018.

* cited by examiner

ACOUSTIC PRESSURE REDUCER AND ENGINEERED LEAK

TECHNICAL FIELD

Aspects and implementations of the present disclosure are directed generally to audio systems.

BACKGROUND

Traditionally, acoustic enclosures such as loudspeaker systems are designed without a way to actively monitor sound pressure and other acoustic conditions within the enclosure during operation. Actively monitoring sound pressure within an acoustic enclosure can help determine the current state of an acoustic system within the enclosure and whether the sound quality within is being optimized. The relatively high acoustic pressures generated inside a loudspeaker can be measured directly by a microphone with a sufficiently high pressure tolerance. However, pressure tolerant microphones are typically expensive and difficult to calibrate making it both costly and complex to actively monitor pressure conditions from within acoustic enclosures.

FIGS. 1A-1C are cross-sectional views depicting various implementations of a conventional loudspeaker system known to those in the art. FIG. 1A depicts a sealed loudspeaker system 151*a* having a housing 152*a* formed of one or more contiguous surfaces arranged to enclose a hollow, three-dimensional chamber of a certain size and shape such that it possesses the desired acoustic properties. An active driver 154*a* is driven by corresponding electronic control circuitry (not shown). An active driver may alternatively be referred to as an electroacoustic transducer, or simply a speaker.

FIG. 1B depicts an additional example of a loudspeaker system 151*b*. FIG. 1B contains all of the features discussed with respect to FIG. 1A with the addition of a port 156 disposed in the housing 152*b*. The dimensions or location of the port 156 may be sized such that it provides desired levels of acoustic resistance and reactance to the acoustic energy propagating through the loudspeaker enclosure. The addition of a port 156 may, for example, enable the loudspeaker to produce lower frequency sounds at higher fidelity and with less driver distortion.

FIG. 1C depicts an additional example of a loudspeaker system 151*c*. FIG. 1C contains all of the features discussed with respect to FIG. 1A with the addition of a passive radiator 158 further disposed in a surface of the housing 152*b*. Passive radiator 158 has a diaphragm capable of vibrating similarly to active driver 154*c*. Unlike an active driver 154*c* however, passive radiator 158 is not electrically driven and instead vibrates in response to the sound pressure inside the loudspeaker produced by active driver 154*c*. The sizing, positioning, and materials used to construct passive radiator 158 are selected such that passive radiator 158 provides a specific level of acoustic resistance or reactance to achieve a desired frequency response. A passive radiator 158 may, for example, provide similar benefits as a port 156 while occupying a smaller volume within the loudspeaker enclosure. A passive radiator 158 may have an adjustable acoustic mass so that the amount of acoustic impedance it provides may be tuned.

It is appreciated by those in the art that a conventional loudspeaker system 151*a*-151*c* may include any number of active drivers 154*a*-154*c*, ports 156, passive radiators 158, or other conventional loudspeaker components necessary to achieve the desired frequency response and other acoustic properties.

SUMMARY

In accordance with an aspect of the present disclosure, there is provided a device and system for reducing, leaking, or measuring one or more acoustic properties of an acoustic system. Examples of acoustic properties include the acoustic pressure produced inside of a loudspeaker or other acoustic enclosure.

An acoustic pressure reducer receives and attenuates an acoustic pressure from at least one external pressure system acoustically coupled to the acoustic pressure reducer causing an attenuated acoustic pressure to occupy an interior chamber of the pressure reducer. Specifically, the acoustic pressure reducer presents an acoustic impedance causing a reduced acoustic pressure to occupy the pressure reducer over a certain range of frequencies. The range of attenuated frequencies may be selected such that it substantially includes some or all of the range that is audible to the unaided human ear. In certain implementations, an acoustic pressure reducer also functions as an engineered leak allowing an ambient pressure of an acoustic system coupled to the pressure reducer to equalize at a known rate with an ambient pressure of an external pressure system, such as the atmosphere. In some implementations, the acoustic pressure reducer includes an acoustic pressure sensor configured to measure an acoustic pressure in the reducer.

Using a model of the pressure reducer's acoustic impedance, a transfer function is determined. An inverse transfer function may then be derived and applied to the acoustic pressure measurements taken within the pressure reducer to estimate the acoustic pressure in the loudspeaker based on the acoustic pressure measured in the pressure reducer. Accordingly, the methods and apparatus described herein provide for a solution to the problem of dynamically monitoring acoustic performance inside an acoustic enclosure and enabling dynamic driver control in response.

According to one aspect, an acoustic pressure reducing system includes an acoustic pressure reducer acoustically coupled to an external acoustic pressure system having a first acoustic pressure and configured to provide acoustic impedance. The acoustic impedance reduces the first acoustic pressure causing a second, attenuated acoustic pressure to occupy an inside chamber of the pressure reducer. An acoustic pressure sensor is disposed within the pressure reducer chamber and configured to measure the second acoustic pressure and provide data to a controller associated with the external acoustic pressure system. Using a model of the pressure transfer characteristics of the pressure reducer, the controller may estimate the acoustic pressure of the first acoustic pressure system and adjust one or more operating characteristics of the first acoustic pressure system responsive to the estimation.

The first acoustic pressure system may occupy an acoustic enclosure such as a loudspeaker system. The acoustic pressure reducer used to attenuate the first acoustic pressure is coupled to the acoustic enclosure via one or more interior apertures, each interior aperture presenting a certain acoustic impedance. Each interior aperture may further include an acoustically-impeding element disposed through the interior aperture and configured to provide additional acoustic impedance. Each pressure reducer may also include one or more exterior apertures configured to acoustically couple the reducer to a third acoustic pressure system, such as an external environment, and provide additional acoustic impedance between the second and third acoustic pressure systems. Each exterior aperture may include an acoustically-impeding element disposed through the exterior aperture and configured to present additional acoustic impedance.

These exemplary aspects and examples are discussed in detail below, along with other aspects, examples, and advantages. Examples disclosed herein may be combined with other examples in any manner consistent with at least one of the principles disclosed herein, and references to "an example," "some examples," "an alternate example," "various examples," "one example", "implementations", or the like are not necessarily mutually exclusive and are intended to indicate that a particular feature, structure, or characteristic described may be included in one or more examples or implementations. The appearances of such terms herein are not necessarily all referring to the same example or implementation. Various aspects, examples described herein may include means for performing any of the described methods or functions.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the disclosure. In the figures, each identical or nearly identical component that is illustrated in various figures is represented by a like numeral. For purposes of clarity, not every component may be labeled in every figure. In the figures.

DETAILED DESCRIPTION

Figure 1A:
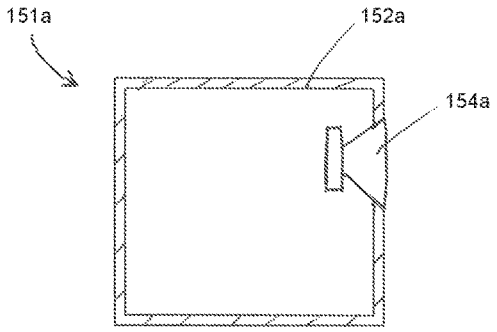
FIG. 1A (prior art)
FIGS. 1A-1C are cross-sectional diagrams depicting various examples of conventional loudspeaker systems.

Loudspeakers and similar acoustic enclosures are typically calibrated in a controlled laboratory environment prior to being sold to end users. During calibration, factors such as ambient pressure conditions, speaker driver excursion behavior, and expected output frequency ranges are often assumed based on one or more static models. However, in practice, these factors will vary over the lifetime of the acoustic enclosure. For example, speaker driver excursion behavior may degrade or vary over time as the speaker ages or wears down with use. Atmospheric pressure conditions change constantly depending on factors such as geographic location and weather. The frequencies of sound being produced inside an acoustic enclosure may also deviate from the expected range based on initial calibration. For example, a loudspeaker may be calibrated to optimize performance of bass-heavy music, but during actual use a speaker operator may prefer to play treble-heavy music instead, or vice versa.

One consequence of calibrating acoustic enclosures in advance is that optimizing performance for one set of conditions may harm performance under another set of conditions. For example, if a loudspeaker is calibrated to optimize bass-heavy music, but a user is playing treble-heavy music, speaker performance can be suboptimal when playing higher frequency sounds. In many instances, a loudspeaker is capable of achieving a better performance under various alternate sets of conditions, but is not calibrated to do so. Accordingly, the ability to detect a change in performance caused by a change in operating conditions would allow certain acoustic systems to be dynamically recalibrated and achieve better performance. However, due to the difficulty of measuring acoustic pressure within an acoustic enclosure (largely because of the relatively high acoustic pressures produced within), it is expensive to monitor the performance of such acoustic systems after calibration. Accordingly, a need exists for a way to monitor acoustic pressure or related acoustic parameters within an acoustic enclosure in near real-time so that acoustic performance under actual operating conditions can be continually evaluated and improved.

Disclosed herein are systems and methods for reducing the acoustic pressure of one or more external acoustic pressure systems using an acoustic pressure reducer. The acoustic pressure reducer acoustically couples to an acoustic system and presents an acoustic impedance, causing an attenuated acoustic pressure to occupy an internal chamber of the pressure reducer. In various implementations, the attenuated acoustic pressure within the chamber is reduced to a level that can be monitored by less expensive or less complex sensing equipment than might be required to directly monitor the unattenuated acoustic pressure within the acoustic enclosure. Specifically, the acoustic pressure reducer is coupled to an acoustic pressure system. In various implementations, the acoustic pressure system is contained in an acoustic enclosure containing an active driver configured to produce acoustic energy having an unattenuated acoustic pressure. The acoustic pressure reducer attenuates an acoustic pressure received from the acoustic pressure system causing an attenuated acoustic pressure to occupy the pressure reducer chamber. An acoustic pressure reducer includes a housing enclosing a chamber having a certain volume. In some implementations, the volume of the chamber is small compared to a volume of the acoustic enclosure so that the acoustic pressure reducer has a minimal or negligible effect on the acoustic conditions within the loudspeaker. In additional implementations, more than one acoustic pressure reducer may be coupled to the acoustic pressure system to achieve various levels of attenuation or perform additional measurements, as is described below.

An acoustic sensor, for example, an acoustic pressure sensor or velocity sensor, is disposed inside the pressure reducer chamber and configured to measure acoustic pressure or acoustic velocity, respectively. A known transfer function of the acoustic pressure reducer is used to determine a corresponding acoustic pressure value inside an acoustic enclosure coupled to the acoustic pressure reducer based on the measurements taken by the acoustic sensor. For example, the acoustic pressure within an acoustic loudspeaker enclosure may be estimated by multiplying the measured, acoustic pressure by the inverse transfer function of the pressure reducer. As mentioned above, acoustic pressure measurements taken within the pressure reducer may be obtained using less expensive or less tolerant equipment than could be operated from within the acoustic enclosure (since the acoustic pressure is reduced inside the chamber). For example, a smaller and less expensive microelectromechanical (MEMS) microphone may be used within the acoustic pressure reducer instead of a conventional microphone.

Figure 2:
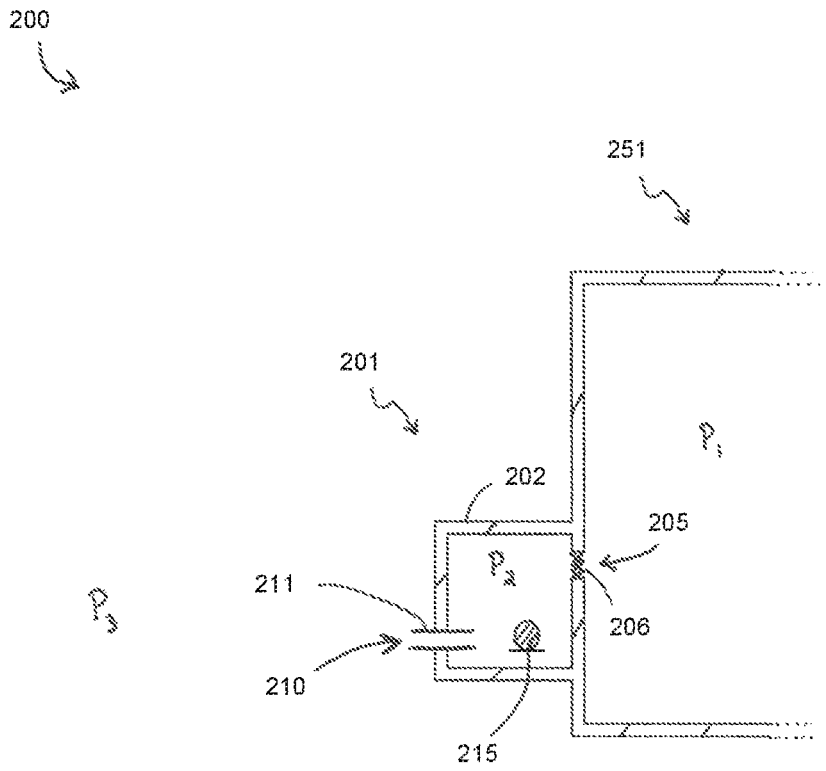
FIG. 2 is a cross-sectional diagram depicting an implementation of an acoustic pressure reducing system.

FIG. 2 is a cross-sectional view depicting an implementation of an acoustic pressure reducing system 200. The acoustic pressure reducing system 200 includes an acoustic pressure reducer 201 acoustically coupled to an acoustic enclosure 251 having an unattenuated acoustic pressure $P_1$. The acoustic pressure reducer 201 includes a housing 202 that encloses a chamber having an attenuated acoustic pressure $P_2$. The housing 202 is formed from one or more contiguous surfaces and may define a chamber of any size or shape depending on the desired acoustic properties. Each surface of the housing 202 may also possess any desired thickness or stiffness based on the desired acoustic properties. The housing 202 may be constructed from any material or combination of materials possessing the desired acoustic properties including wood, plastic, metal, polymers, ceramics, glass, composite materials, or combinations thereof.

The acoustic enclosure 251 containing the unattenuated acoustic pressure is acoustically coupled to the acoustic pressure reducer 201 through one or more interior apertures 205. In the example illustrated in FIG. 2, a single interior aperture 205 is formed in the reducer housing 202 in one of the surfaces adjacent to the acoustic enclosure 251. Each interior aperture 205 is configured to provide a certain amount of acoustic impedance. Acoustic impedance, as known to those in the art, includes both a real component (acoustic resistance) and an imaginary component (acoustic reactance). Depending on the ratio between and magnitudes of acoustic resistance and acoustic reactance, a source of acoustic impedance may be treated as substantially resistive or substantially reactive with respect to how it affects acoustic pressure and other acoustic properties at certain frequencies.

An acoustically-impeding element 206 may be placed within or through an interior aperture 205 and configured to provide additional acoustic impedance. In the example illustrated in FIG. 2, an acoustic screen 206 is sized to match the cross-sectional dimensions of the interior aperture 205 and placed within the interior aperture 205 such that it covers substantially the entire cross-sectional area of the interior aperture 205.

The pressure reducer may also have one or more exterior apertures 210 configured to provide additional acoustic impedance. In the example illustrated in FIG. 2, the reducer 201 has a single exterior aperture 210 that acoustically couples the reducer chamber to an external environment having an acoustic pressure $P_3$. The external environment may, for example, be the Earth's atmosphere or may instead be a different medium. Those skilled in the art will appreciate that in implementations where the volume of the external environment is sufficiently large, such as the volume of Earth's atmosphere or a large enough room, the steady-state value of the acoustic pressure $P_3$ will approach a value of zero relative to $P_2$ and $P_1$ over time.

An acoustically-impeding element 211 may be placed within or through the exterior aperture 210 and may be configured to provide additional acoustic impedance. In the example illustrated in FIG. 2, an acoustic port 211 is sized to match the cross-sectional dimensions of the exterior aperture 210 and is placed through the exterior aperture 210 such that it covers substantially the entire cross-sectional area of the exterior aperture 210.

In various implementations including the example shown in FIG. 2, the presence of at least one permeable (open to at least some acoustic volume flow) exterior aperture 210 in addition to at least one permeable interior aperture 205 creates an ambient pressure leak that allows for ambient pressure to equalize between an external environment, the acoustic pressure reducer 201, and the acoustic enclosure 251 at a certain rate. The rate of ambient pressure equalization may be controlled by varying the amount of permeability of apertures 205, 210 and acoustically-impeding elements 206, 211. Specifically, more permeable apertures 205, 210 and elements 206, 211 will allow for a greater rate of ambient pressure equalization through a respective aperture. However, changing the permeability of each aperture or acoustically-impeding element may also affect how acoustic pressure and other acoustic properties are attenuated or filtered.

At least one acoustic sensor 215 is disposed within the pressure reducer chamber 201 and configured to measure an acoustic quantity. In the example illustrated in FIG. 2, the acoustic sensor 215 is an acoustic pressure sensor, for example, a MEMS microphone. The MEMS microphone 215 is configured to communicate acoustic pressure measurements to an external controller (not shown), which may be located inside the acoustic enclosure 251. MEMS microphones are typically less expensive than conventional microphones, but often have lower acoustic pressure tolerances over various frequencies. The relatively high acoustic pressure generated within certain acoustic enclosures ($P_1$), for example, within a loudspeaker, typically falls outside of the pressure tolerance of a MEMS microphone. However, the unattenuated acoustic pressure $P_1$ generated within a loudspeaker can be sufficiently reduced such that the attenuated acoustic pressure $P_2$ measured within the chamber falls sufficiently within the pressure tolerance of the MEMS microphone.

In various other implementations, interior apertures 205 and exterior apertures 210 may be fitted with other types of acoustically-impeding elements 206, 211, respectively. Types of acoustically-impeding elements include acoustic screens, meshes, ports, diaphragms, orifices, and various groups and combinations thereof. Each type of acoustically-impeding element provides one or more advantages. For example, a port can be configured to present a significant acoustic reactance (mass) in addition to an acoustic resistance, which may help attenuate or filter certain frequencies more than others. In contrast, an acoustic screen can be configured to present substantially zero acoustic reactance over a large portion of the audible frequency range, causing the acoustic screen to behave as a linear acoustic resistor over the corresponding range of acoustic pressure frequency values.

Still referring to FIG. 2, using a mathematical model of the acoustic pressure reducer 201, it is possible to measure the attenuated acoustic pressure $P_2$ within the reducer chamber and responsively determine the unattenuated acoustic pressure $P_1$ in the acoustic enclosure 251. Specifically, an acoustic pressure reduction factor can be determined based on the following models. For designs involving interior apertures, exterior apertures, and acoustically-impeding elements including orifices, screens, or ports, Equation (1) below applies:

$$\frac{P_1}{P_2} = \frac{Z_1 Z_2 + Z_C(Z_1 + Z_2)}{Z_C Z_2} \tag{1}$$

In Equation (1), $P_1$ refers to the acoustic pressure of an acoustic enclosure, such as a loudspeaker, coupled to the one or more pressure reducer interior apertures. Similarly, $P_2$ refers to the acoustic pressure within the pressure reducer chamber, $Z_1$ refers to the equivalent acoustic impedance presented by the one or more interior apertures, $Z_2$ refers to the equivalent acoustic impedance presented by the one or more exterior apertures (if any), and $Z_C$ refers to the acoustic impedance presented by the volume inside the pressure reducer chamber.

For designs involving one or more stiff diaphragms and no permeable interior and exterior apertures, Equation (2) below applies:

$$\frac{P_1}{P_2} = \frac{\frac{Z_{dia}}{A^2} + Z_C}{Z_C} \tag{2}$$

In Equation (2), variables in common with Equation (1) refer to the same quantities. In addition, $Z_{dia}$ refers to the equivalent mechanical impedance presented by one or more stiff diaphragms and A refers to the equivalent area presented by the one or more stiff diaphragms.

In some implementations, acoustic pressure data measured by the acoustic pressure sensor 215 is sent to an external processor. Using the pressure reduction factor derived from the mathematical model of the pressure reducer, the unattenuated acoustic pressure $P_1$ within the acoustic enclosure is derived by multiplying a set of pressure data representing the attenuated pressure $P_2$ within the chamber by the pressure reduction factor.

Knowing the actual acoustic pressure conditions within the acoustic enclosure 251 (e.g. a loudspeaker) allows the acoustic system to be dynamically tuned or driven differently in accordance with variable environmental or operating conditions. For example, if the actual pressure conditions within a loudspeaker system indicate that an active driver has additional excursion overhead available at certain frequencies, then the loudspeaker system may provide additional power to the driver at some or all of those frequencies. This may allow for the speaker to operate at louder volumes without causing distortion or other undesirable acoustic effects. By continuously or periodically monitoring the pressure conditions within the loudspeaker or other acoustic enclosure 251 containing the unattenuated acoustic pressure $P_1$, it is possible to dynamically optimize the performance of the system in accordance with changing operating conditions as described above.

FIGS. 3-8 are cross-sectional views depicting various implementations of an acoustic pressure reducer 301-801, respectively.

Figure 3:
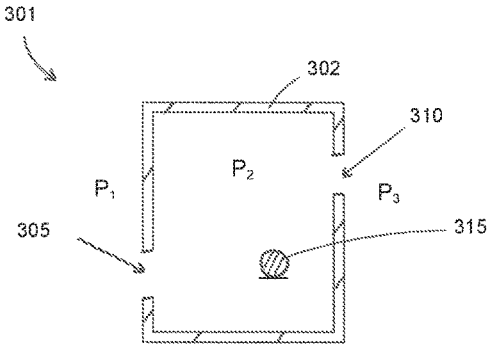
FIG. 3 is a cross-sectional diagram depicting an implementation of an acoustic pressure reducer.

FIG. 3 depicts an example implementation of an acoustic pressure reducer 301. A single interior aperture 305 and a single exterior aperture 310 are disposed on opposing surfaces of the housing 302. In various other embodiments, interior apertures 305 and exterior apertures 310 may be placed on other surfaces that are not opposing and still perform similar functions. The unattenuated acoustic pressure ($P_1$) acoustically coupled to the pressure reducer via the interior aperture 305 is attenuated by the acoustic impedances presented by the interior aperture 305 ($Z_1$), the volume inside the chamber ($Z_C$), and the exterior aperture 310 ($Z_2$) causing an attenuated acoustic pressure ($P_2$) to occupy the chamber. In various implementations, the volume of the chamber is minimized to reduce or make negligible the acoustic impedance presented by the medium within the chamber ($Z_C$).

An acoustic pressure sensor 315 measures the attenuated acoustic pressure occupying the chamber ($P_2$). The size and shape of each aperture 305, 310 may be varied to achieve a desired overall acoustic transfer function for the pressure reducer, as described with respect to FIG. 2. The transfer function for the acoustic pressure reducer of FIG. 3 may be calculated using the mathematical model previously established in Equations (1) and (2).

Figure 4:
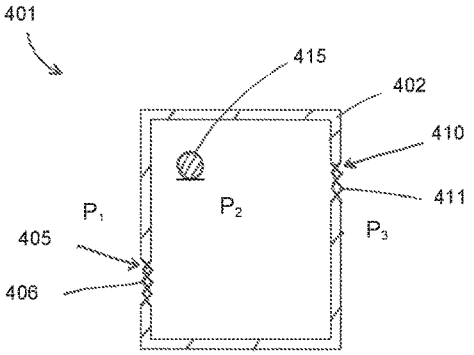
FIG. 4 is a cross-sectional diagram depicting another implementation of an acoustic pressure reducer.

FIG. 4 depicts another example implementation of an acoustic pressure reducer 401. A single interior aperture 405 and a single exterior aperture 410 are disposed on opposing surfaces of the housing 402. The reducer 401 includes acoustically resistive screens 406 and 411 mounted across the interior aperture 405 and exterior aperture 410, respectively. The screens 406 and 411 provide additional acoustic impedance at each respective location. The unattenuated acoustic pressure ($P_1$) coupled to the pressure reducer via the interior aperture 405 is attenuated by the acoustic impedances presented by the interior aperture 405 and screen 406 ($Z_1$), the volume inside the chamber ($Z_C$), and the exterior aperture 410 and screen 411 ($Z_2$) causing an attenuated acoustic pressure ($P_2$) to occupy the chamber. An acoustic pressure sensor 415 is disposed within the housing 402 to measure the attenuated acoustic pressure ($P_2$) occupying the chamber. Compared to the design 301 of FIG. 3, the acoustic pressure reducer 401 may be capable of achieving additional pressure reduction due to the presence of additional acoustic impedance provided by screens 406 and 411.

In one example, the housing 402 encloses a chamber having a volume equal to 0.5 cubic centimeters. The interior aperture 405 has a 3 mm radius and is covered with a first acoustic screen having a 4000 [Ray1] specific acoustic impedance. As is known to those in the art, the acoustic impedance of a screen element may be calculated via its specific acoustic impedance and its cross-sectional area. An exterior aperture 410 having a 4 mm radius is covered with a second acoustic screen having a 70 [Ray1] specific acoustic impedance. In this example, the volume of the chamber is small enough that the chamber's acoustic impedance ($Z_C$) may be regarded as negligible compared to the equivalent input acoustic impedance ($Z_1$) and the equivalent output acoustic impedance ($Z_2$) pursuant to Equation (1). A constant pressure reduction factor of 105 over a certain range of frequencies may therefore be calculated using Equation (1), meaning $P_1$ divided by $P_2$ is equal to approximately 105. Accordingly, the attenuated acoustic pressure occupying the chamber ($P_2$) is reduced by a factor of 105 relative to the unattenuated acoustic pressure ($P_1$). Therefore, the sound occupying the pressure reducer will be attenuated by approximately 40 decibels $$\left(\frac{1}{105} \text{ in dB} = 20 \log_{10}\frac{1}{105} \approx -40 \text{ dB}\right).$$

Figure 5:
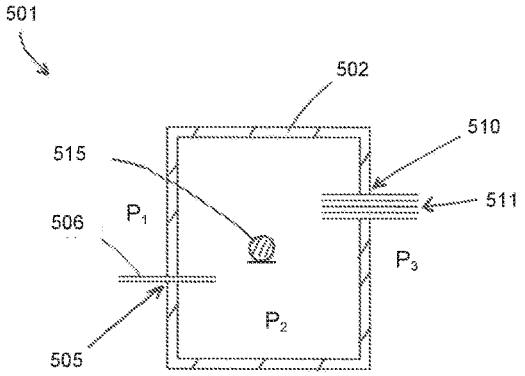
FIG. 5 is a cross-sectional diagram depicting another implementation of an acoustic pressure reducer.

FIG. 5 depicts another example implementation of an acoustic pressure reducer 501. A single interior aperture 505 and a single exterior aperture 510 are disposed on opposing surfaces of the housing 502. The reducer 501 includes an acoustically impeding port 506 mounted through the interior aperture 505, and four acoustically impeding ports 511 mounted across the exterior aperture 510. The ports 506 and 511 can provide additional acoustic reactance at certain frequencies relative to substantially linear elements such as an acoustic screen, which may be desirable for attenuating certain frequencies or frequency bands. The unattenuated acoustic pressure ($P_1$) coupled to the pressure reducer via the interior aperture 505 is attenuated by the acoustic impedances presented by the interior aperture 505 and port 506 ($Z_1$), the volume inside the chamber ($Z_C$), and the exterior aperture 510 and ports 511 ($Z_2$) causing an attenuated acoustic pressure ($P_2$) to occupy the chamber. An acoustic pressure sensor 515 is disposed within the housing 502 to measure the acoustic pressure within the pressure reducer housing 502.

In one example, the housing 502 encloses a chamber having a volume equal to 0.5 cubic centimeters. The port 506 has a circular cross-section with a 0.15 mm radius and has a 10 mm length. The port 506 presents a $$9.3*10^8 + 1.4*10^8 j \left[\frac{\text{Pa}*\text{s}}{\text{m}^3}\right]$$

acoustic impedance at 100 [Hz], where j equals the square root of −1 herein. The group of four ports 511 each have a circular cross-section with a 0.25 mm radius and each have a 3 mm length and collectively present an $$8.9*10^6 + 3.8*10^6 j \left[\frac{\text{Pa}*\text{s}}{\text{m}^3}\right]$$

acoustic impedance at 100 [Hz]. In this example, the volume of the chamber is small enough that the chamber's acoustic impedance $Z_c$ may be regarded as negligible compared to the equivalent interior acoustic impedance ($Z_1$) and the equivalent exterior acoustic impedance ($Z_2$) pursuant to Equation (1). A constant pressure reduction factor of 105 over a certain range of frequencies may therefore be calculated using Equation (1), meaning $P_1$ divided by $P_2$ is equal to approximately 105. Accordingly, the attenuated acoustic pressure occupying the chamber ($P_2$) will be reduced by a factor of 105 relative to the unattenuated acoustic pressure ($P_1$). Therefore, the sound occupying the pressure reducer will be attenuated by approximately 40 decibels $$\left(\frac{1}{105} \text{ in dB} = 20 \log_{10}\frac{1}{105} \approx -40 \text{ dB}\right).$$

Figure 6:
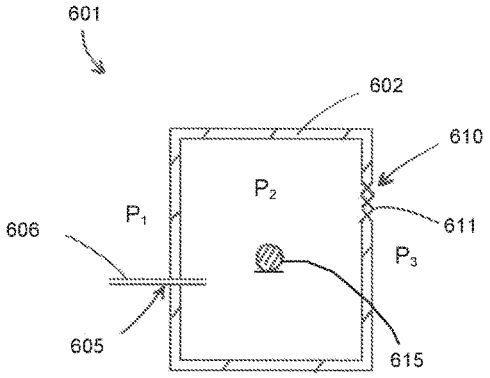
FIG. 6 is a cross-sectional diagram depicting another implementation of an acoustic pressure reducer.

FIG. 6 depicts another example implementation of an acoustic pressure reducer 601. A single interior aperture 605 and a single exterior aperture 610 are disposed on opposing surfaces of the pressure reducer housing 602. The reducer 601 includes a port 606 mounted through the interior aperture 605, and an acoustic screen 611 mounted across the exterior aperture 610. The unattenuated acoustic pressure ($P_1$) coupled to the pressure reducer via the interior aperture 605 is attenuated by the acoustic impedances presented by the interior aperture 605 and port 606 ($Z_1$), the volume inside the chamber ($Z_C$), and the exterior aperture 610 and screen 611 ($Z_2$) causing an attenuated acoustic pressure ($P_2$) to occupy the chamber. An acoustic pressure sensor 615 is disposed within the housing 602 to measure the attenuated acoustic pressure ($P_2$) within the housing 602.

In one example, the housing 602 encloses a chamber having a volume equal to 0.5 cubic centimeters. The port 606 has a cross-section with a 0.2 mm radius and has a 5 mm length and therefore presents a $$1.5*10^8 + 3.9*10^7 j \left[\frac{\text{Pa}*\text{s}}{\text{m}^3}\right]$$

acoustic impedance at 100 [Hz]. The screen 611 has a cross-section with a 4 mm radius and a 70 ray1 specific acoustic impedance and therefore presents an acoustic impedance of 70 [ray1]/($\pi$*0.004$^2$) [m$^2$]. In this example, the volume of the chamber is small enough that the chamber's acoustic impedance $Z_c$ may be regarded as negligible compared to the equivalent interior acoustic impedance ($Z_1$) and the equivalent exterior acoustic impedance ($Z_2$) pursuant to Equation (1). A constant pressure reduction factor of 105 over a certain range of frequencies may therefore be calculated using Equation (1), meaning $P_1$ divided by $P_2$ is equal to approximately 105. Accordingly, the attenuated acoustic pressure occupying the chamber ($P_2$) will be reduced by a factor of 105 relative to the unattenuated acoustic pressure ($P_1$). Therefore, the sound occupying the pressure reducer will be attenuated by approximately 40 decibels $$\left(\frac{1}{105} \text{ in dB} = 20 \log_{10}\frac{1}{105} \approx -40 \text{ dB}\right).$$

Figure 7:
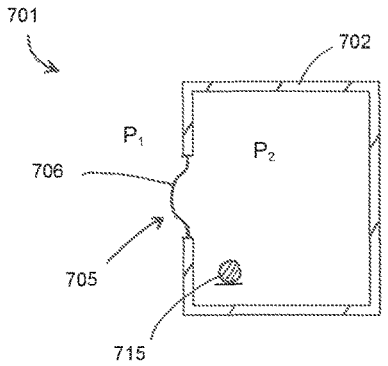
FIG. 7 is a cross-sectional diagram depicting another implementation of an acoustic pressure reducer.

FIG. 7 depicts another example implementation of an acoustic pressure reducer 701. A single interior aperture 705 is disposed on a surface of the housing 702. An acoustically-impeding stiff diaphragm 706 is mounted across the interior aperture 705. The unattenuated acoustic pressure ($P_1$) coupled to the pressure reducer via the interior aperture 705 is attenuated by the acoustic impedance presented by the stiff diaphragm 706 ($Z_c$) and the volume inside the chamber ($Z_C$) causing an attenuated acoustic pressure ($P_2$) to occupy the chamber. An acoustic pressure sensor 715 is disposed within the housing 702 to measure the attenuated acoustic pressure ($P_2$) within the housing 702.

In one example, the pressure reducer housing 702 encloses a chamber having a volume equal to 0.5 cubic centimeters. The stiff diaphragm 706 is configured to be 100 times more mechanically rigid than the mechanical rigidity of the gas or other medium inside the chamber. An acoustic pressure reduction factor of 100 over a certain range of frequencies may therefore be calculated using Equation (2), meaning $P_1$ divided by $P_2$ is equal to approximately 100.

Accordingly, the attenuated acoustic pressure occupying the chamber ($P_2$) will be reduced by a factor of 100 relative to the unattenuated acoustic pressure ($P_1$). Therefore, the acoustic pressure occupying the pressure reducer will be attenuated by 40 decibels $$\left(\frac{1}{100} \text{ in dB} = 20 \log_{10} \frac{1}{100} = -40 \text{ dB}\right).$$

Figure 8:
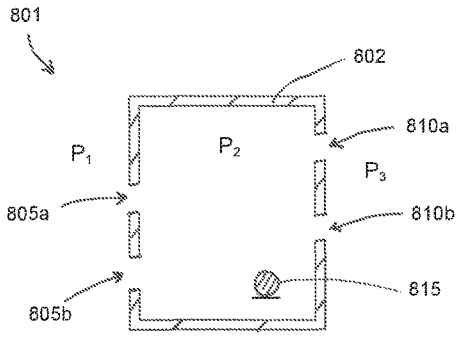
FIG. 8 is a cross-sectional diagram depicting another implementation of an acoustic pressure reducer.

FIG. 8 depicts another example implementation of an acoustic pressure reducer 801. The pressure reducer 801 includes two interior apertures 805*a* and 805*b* and two exterior apertures 810*a* and 810*b*, each group disposed on different surfaces of the housing 802. The unattenuated acoustic pressure ($P_1$) coupled to the pressure reducer via the interior aperture 805 is attenuated by the acoustic impedances presented by the interior apertures 805*a*, 805*b* ($Z_1$), the volume inside the chamber ($Z_C$), and the exterior apertures 810*a* and 810*b* ($Z_2$) causing an attenuated acoustic pressure ($P_2$) to occupy the chamber. An acoustic pressure sensor 815 is disposed within the housing 802 to measure the acoustic pressure within the housing 802.

Although in the example illustrated in FIG. 8 each interior and exterior aperture is depicted as not containing an acoustically-impeding element, in various other implementations some or all of the interior apertures 805*a*, 805*b* and exterior apertures 810*a*, 810*b* may be fitted with one or more of the acoustically-impeding elements discussed herein to achieve a modified level of acoustic impedance. Further, the presence of one or more additional interior apertures 805*b* in addition to the first interior aperture 805*a* will modify the total level of acoustic impedance presented by the pressure reducer at the interior apertures. For example, the inclusion of additional interior aperture 805*b* in parallel with the first interior aperture 805*a* will decrease the total acoustic impedance presented by the pressure reducer at the interior apertures. Similarly, the presence of one or more additional exterior apertures 810*b* in addition to the first exterior aperture 810*a* will modify the total level of acoustic impedance presented by the pressure reducer at the exterior apertures. For example, the inclusion of additional exterior aperture 810*b* in parallel with the first exterior aperture 810*a* will decrease the total acoustic impedance presented by the pressure reducer at the exterior apertures.

Although in each of FIGS. 3-8 and various other examples herein interior and exterior apertures are pictured as disposed on opposite surfaces of the acoustic pressure reducer housing, apertures may be disposed on any housing surface sufficient to allow the interior or exterior aperture to acoustically couple to an external acoustic system or external environment, respectively.

Figure 1B:
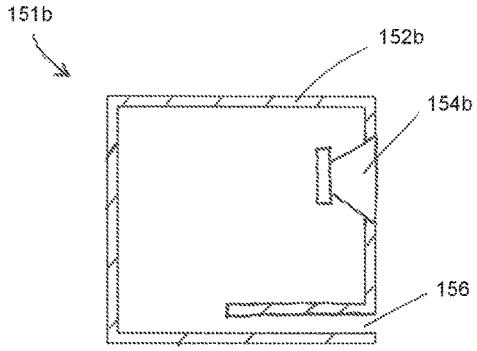
FIG. 1B (prior art)
Figure 1C:
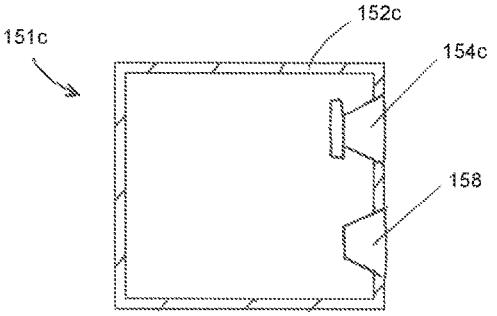
FIG. 1C (prior art)
Figure 9:
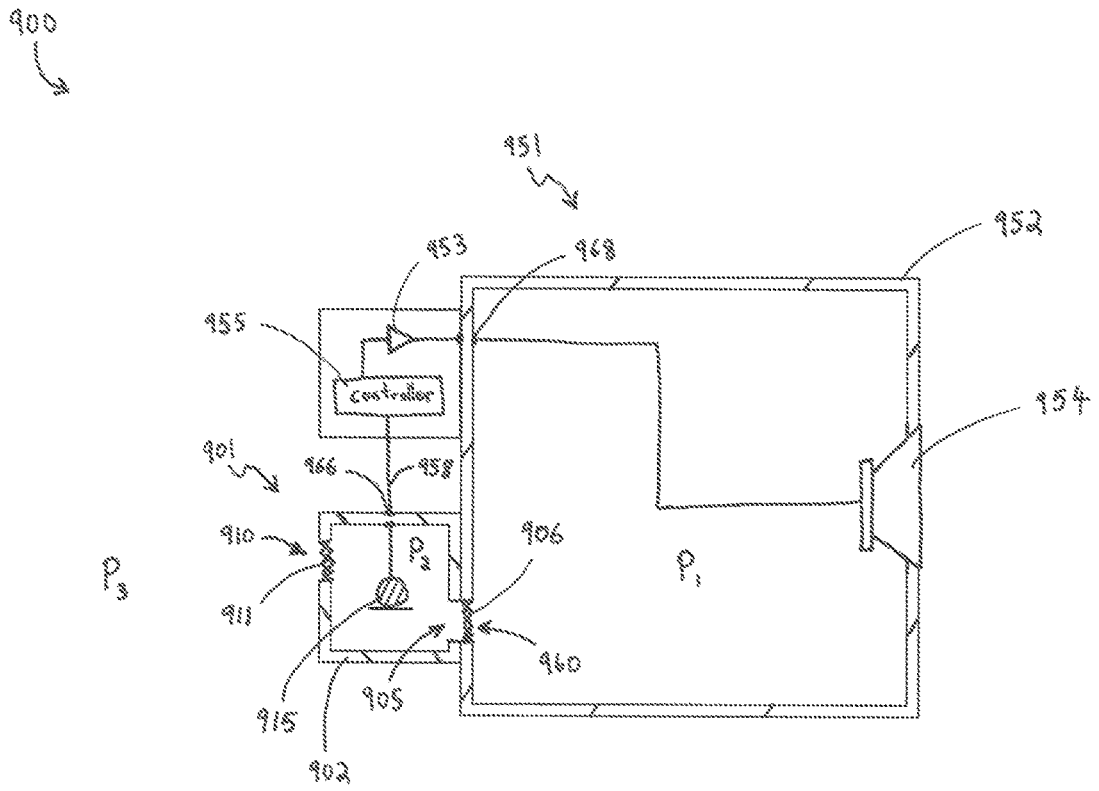
FIG. 9 is a cross-sectional diagram depicting another implementation of an acoustic pressure reducing system.
Figure 10:
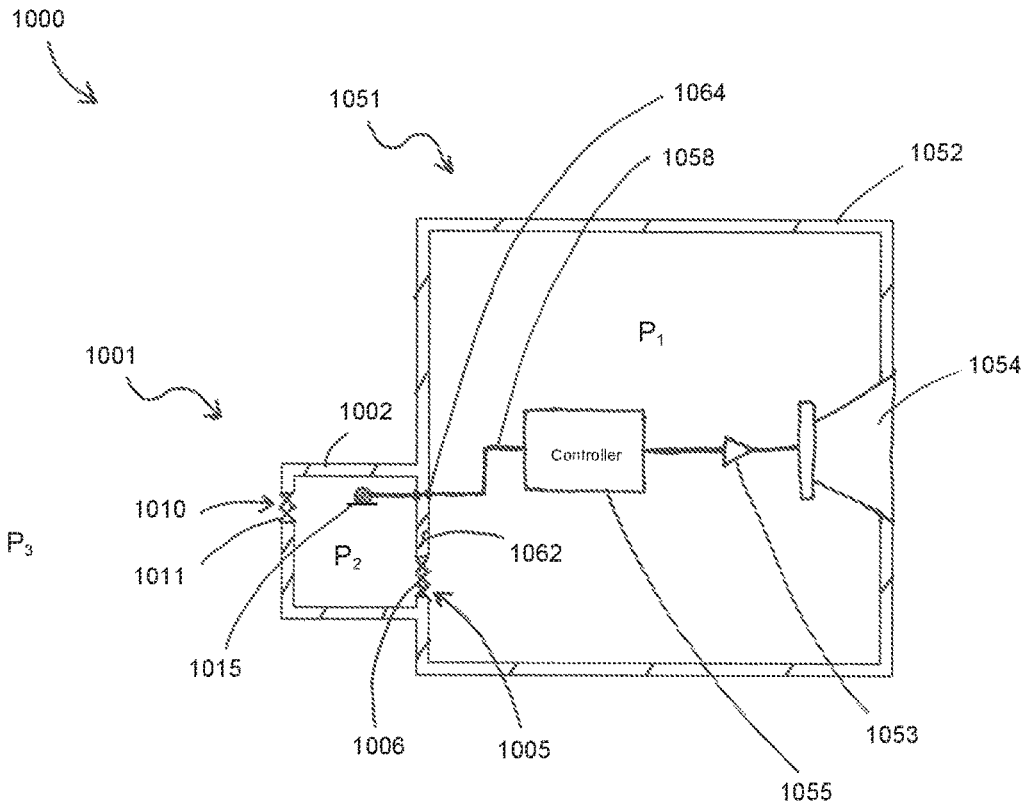
FIG. 10 is a cross-sectional diagram depicting another implementation of an acoustic pressure reducing system.

FIGS. 9-10 are cross-sectional schematic views depicting implementations of an acoustic pressure reducing system 900, 1000 including a loudspeaker system 951, 1051 coupled to an acoustic pressure reducer 901, 1001, respectively. The acoustic pressure reducing systems 900, 1000 are similar to the acoustic pressure reducing system 200 described with respect to FIG. 2 except that the acoustic enclosures 951, 1051 containing the unattenuated acoustic pressure $P_1$ are specifically loudspeaker systems, such as those described with respect to FIGS. 1A-1C.

The loudspeaker systems 951, 1051 each respectively include a housing 952, 1052 and an active driver 954, 1054. Each loudspeaker system 951, 1051 also respectively includes amplifiers 953, 1053 configured to provide electric power to drive the active drivers, and controllers 955, 1055 that provide signals to each respective amplifier. Each controller 955, 1055 may also be capable of performing one or more digital signal processing (DSP) functions. The acoustic pressure reducers 901, 1001 are each disposed adjacent to one of the surfaces of the respective loudspeaker housings 952, 1052. In the example shown in FIG. 9, a wired connection 958 connects the pressure sensor 915 to the amplifier 953 and controller 955 located in an external enclosure outside of the loudspeaker 951. In certain implementations, the amplifier 953 may be located inside the loudspeaker 951. The wired connection 958 penetrates the pressure reducer housing 902 and loudspeaker housing 952 through additional wire apertures 966, 968, respectively. In other examples, such as the example depicted in FIG. 10, a wire aperture 1064 is included for passing a wired connection between the pressure reducer chamber 1002 and the loudspeaker enclosure 1051 directly.

The acoustic pressure sensors 915, 1015 are each able to measure the acoustic pressure $P_2$ within the chamber of the acoustic pressure reducers 901, 1001, respectively. Each acoustic pressure sensor 915, 1015 sends acoustic pressure data to each respective controller 955, 1055. The controllers 955, 1055 can use the acoustic pressure data combined with predetermined knowledge of the transfer function of each pressure reducer and other performance-based algorithms to determine one or more ways that sound performance of the loudspeaker can be improved. The controllers 955, 1055 can then vary the signals being sent to each respective amplifier 953, 1053, which provide amplified signals to each respective active driver 954, 1054. By varying the signals sent by each controller 955, 1055 to each respective amplifier 953, 1053, the controllers can, for example, vary the amount of driver excursion occurring at various frequencies and improve sound performance or loudspeaker health.

Some implementations may contain an acoustic velocity sensor or driver displacement sensor that can measure acoustic velocity or loudspeaker excursion, respectively, instead of or in addition to an acoustic pressure sensor 915, 1015. Values for acoustic pressure, acoustic velocity, or driver displacement may be used to calculate additional acoustic parameters of the acoustic energy occupying the loudspeaker 951, 1051. For example, the acoustic pressure, acoustic velocity, or driver displacement may be used along with additional known parameters of the loudspeaker system (such as enclosure volume) to derive acoustic values within the loudspeaker such as frequency composition, acoustic volume flow, or other acoustic parameters known to those in the art.

Referring to FIG. 9, the pressure reducer housing 902 is shown as entirely distinct from the loudspeaker housing 952. A loudspeaker exterior aperture 960 is disposed on one of the surfaces of the loudspeaker housing 952 and aligned with the pressure reducer interior aperture 905. In some implementations, the size of the loudspeaker exterior aperture 960 is made substantially identical to the size of pressure reducer interior aperture 905. However, in other implementations, either the loudspeaker exterior aperture 960 or the pressure reducer interior aperture 905 may have a smaller cross-sectional area. An acoustic screen 906 is shown as being placed through the loudspeaker exterior aperture 960. However, those skilled in the art will appreciate that in various implementations an acoustically-impeding element 906 may be placed through either the loudspeaker exterior aperture 960 or the pressure reducer interior aperture 905 depending on the type of acoustically-impeding element being used and the relative sizes of apertures 905 and 960. A pressure reducer exterior aperture 910 is disposed in the pressure reducer housing 902 and configured to provide additional acoustic impedance. An acoustic screen 911 is placed through the exterior aperture 910 to provide further acoustic impedance.

Referring to FIG. 10, the pressure reducer housing 1002 and the loudspeaker housing 1052 share a common, integral housing surface 1062. In this example, there is no separate loudspeaker exterior aperture since the pressure reducer interior aperture 1005 containing an acoustic screen 1006 is integral with both the pressure reducer housing 1002 and the loudspeaker housing 1052 on the common housing surface 1062. In various other examples, one or more acoustic pressure reducers coupled to the loudspeaker 1051 may share common housing surfaces 1062 or may instead have separate housing surfaces containing loudspeaker exterior apertures to align with respective pressure reducer interior apertures, as is described with respect to FIG. 9. A pressure reducer exterior aperture 1010 is disposed in the pressure reducer housing 902 and configured to provide additional acoustic impedance. An acoustic screen 1011 is placed through the exterior aperture to provide further acoustic impedance.

Figure 11:
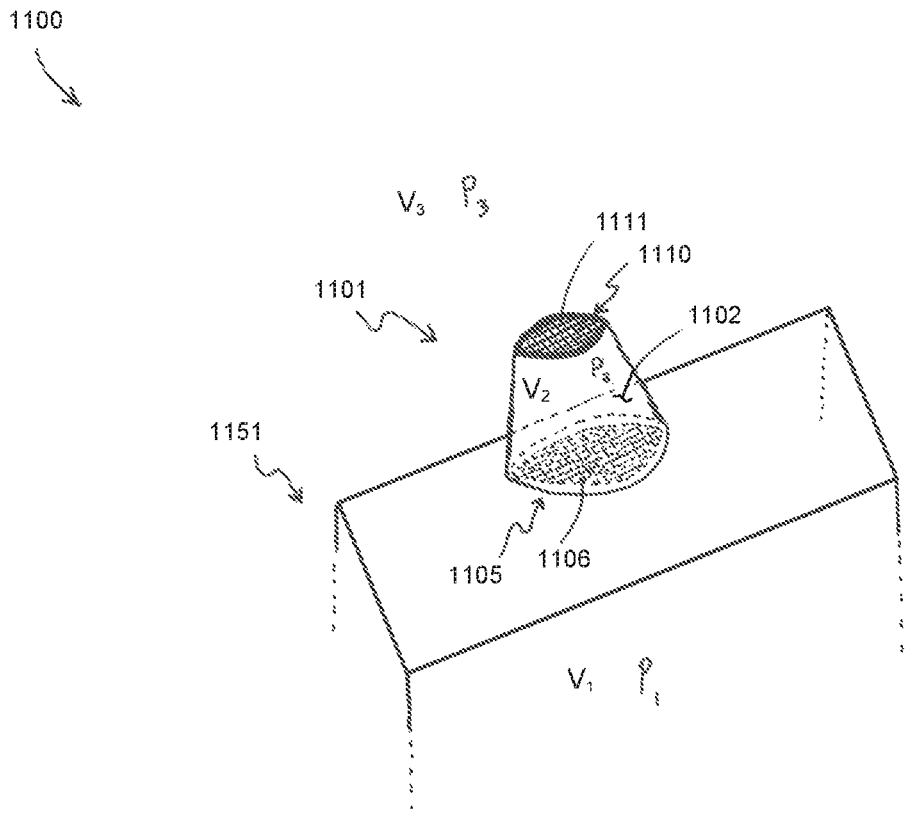
FIG. 11 is a perspective diagram depicting another implementation of an acoustic pressure reducing system.

FIG. 11 is a perspective view depicting an example acoustic pressure reducing system 1100 similar to the acoustic pressure reducing system 200 described with respect to FIG. 2. An acoustic system 1151 enclosing a first volume $V_1$ having a first acoustic pressure $P_1$ is acoustically coupled to an acoustic pressure reducer 1101 enclosing a second volume $V_2$ having a second acoustic pressure $P_2$. The pressure reducer 1101 includes a housing 1102 in the shape of a conical frustum. An interior aperture 1105 is disposed along a base of the housing between the first volume and the second volume and covered with a first acoustically-impeding element 1106—in this example a first acoustic screen. The pressure reducer further includes an exterior aperture 1110 disposed along a base of the housing between the second volume and the third volume and is covered with a second acoustically-impeding element 1111—in this example a second acoustic screen. The first acoustic pressure ($P_1$) is reduced by an equivalent acoustic impedance presented by the pressure reducer 1101 causing the second acoustic pressure ($P_2$) to occupy the pressure reducer chamber. Specifically, the equivalent acoustic impedance presented by the pressure reducer 1101 includes the acoustic impedances presented by the interior aperture 1105 and first acoustic screen 1106 ($Z_1$), the volume inside the pressure reducer chamber ($Z_C$), and the exterior aperture 1110 and second acoustic screen 1111 ($Z_2$).

In various implementations, the dimensions of the housing 1102, the shapes and sizes of the interior and exterior apertures 1105, 1110, and the types of acoustically-impeding elements 1106, 1111 are each chosen to achieve a certain overall level of acoustic pressure reduction. Based on the configuration selected for the components above, a pressure reduction factor may be calculated based on the models presented in Equations (1) and (2). A pressure sensor (not shown), such as the pressure sensor 215 described with respect to FIG. 2, is disposed inside the pressure reducer housing 1102 and connected to a controller, such as the controller 955, 1055 described with respect to FIGS. 9 and 10, respectively.

As discussed above with respect to FIG. 2, the inclusion of at least one permeable exterior aperture 1110 and at least one permeable interior aperture 1105 provides for a leak of ambient pressure. Specifically, the leak forces the mean pressure of the three volumes $V_1$, $V_2$, and $V_3$ to equalize to a common value at a certain rate. The ambient pressure between all three volumes is able to equalize over a certain amount of time depending on the permeability of the apertures 1105, 1110, or any other apertures present in other examples. Controlling the rate of the leak may, for example, prevent an overly large ambient pressure differential from forming between the acoustic enclosure and the external environment. Including a controlled leak in the design of the pressure reducing system 1100 may further simplify design considerations of the acoustic enclosure housing the first volume by eliminating or reducing the need to include a separate ambient pressure leak.

Figure 12:
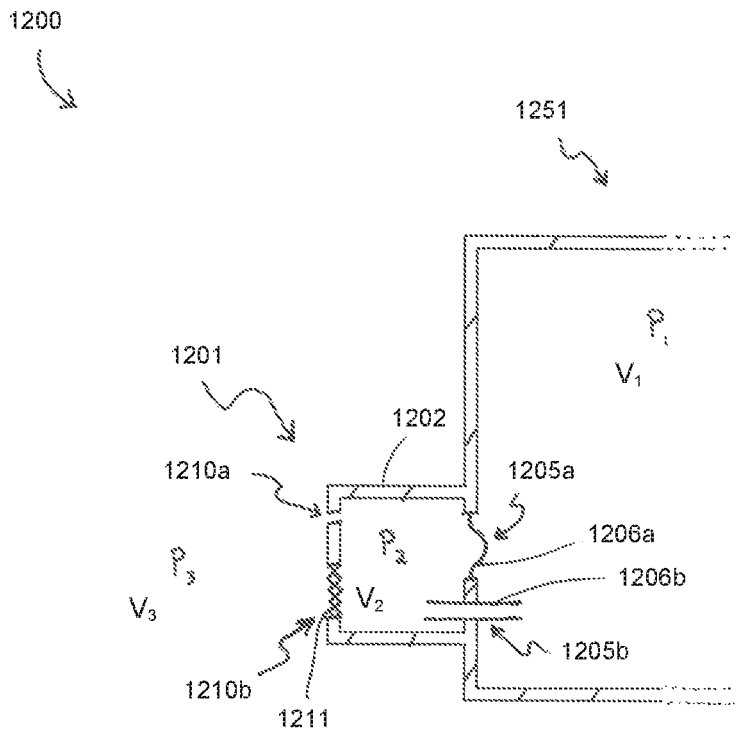
FIG. 12 is a cross-sectional diagram depicting an additional implementation of an acoustic pressure reducing system.

FIG. 12 is a cross-sectional view depicting an example implementation of an acoustic pressure reducing system 1200 similar to the acoustic pressure reducing system 200 described with respect to FIG. 2. An acoustic system 1251 having a first volume ($V_1$) with a first acoustic pressure ($P_1$) is coupled to the pressure reducer 1201 via a first interior aperture 1205*a* and a second interior aperture 1205*b*. The first interior aperture 1205*a* is covered with a first acoustically-impeding element 1206*a*—in this example a stiff diaphragm. The second interior aperture 1205*b* includes a second acoustically-impeding element 1206*b*—in this example a port. The first exterior aperture 1210*a* is an acoustic orifice not covered by any additional elements. The second exterior aperture 1210*b* is covered with a third acoustically-impeding element 1211—in this example an acoustic screen. The first acoustic pressure ($P_1$) is attenuated by the acoustic impedances presented by the interior apertures 1205, 1205*b*, the stiff diaphragm 1206*a*, and the port 1206*b* ($Z_1$); the volume inside the chamber ($Z_C$); and the exterior apertures 1210*a*, 1210*b* and the screen 1211 ($Z_2$) causing an attenuated acoustic pressure ($P_2$) to occupy the second volume ($V_2$) in accordance with Equations (1) and (2).

In various implementations, such as the example depicted in FIG. 12, a plurality of interior apertures 1205 and exterior apertures 1210 may each be coupled to the first volume ($V_1$) containing the first acoustic pressure $P_1$ and an external volume ($V_3$) containing a third acoustic pressure $P_3$, respectively. The plurality of interior apertures 1205 and exterior apertures 1210 are combined in parallel to achieve an equivalent acoustic input impedance or equivalent acoustic output impedance, respectively, that varies relative to the acoustic impedance presented by a single aperture or on its own. Each of the plurality of apertures 1205, 1210 may be further fitted with any of the acoustically-impeding elements described herein in accordance with achieving a desired pressure reducer transfer function.

Figure 13:
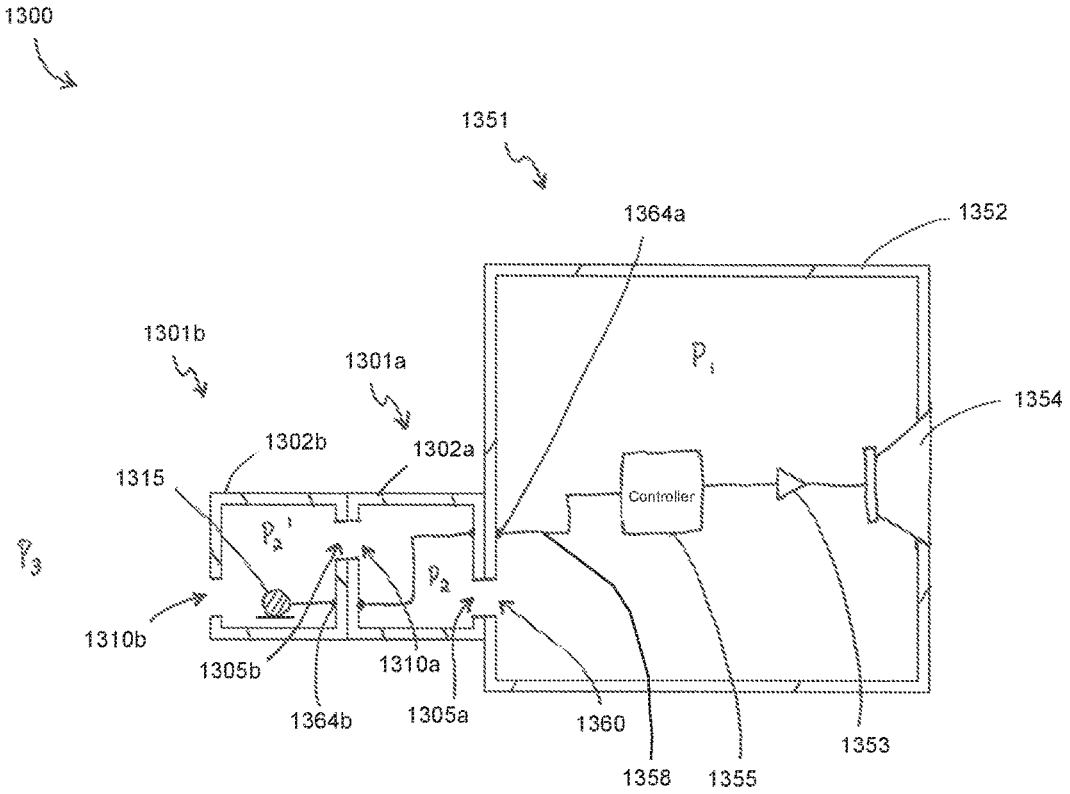
FIG. 13 is a cross-sectional diagram depicting an additional implementation of an acoustic pressure reducing system.

FIG. 13 is a cross-sectional view depicting another implementation of an acoustic pressure reducing system 1300. The acoustic pressure reducing system 1300 is coupled to an acoustic enclosure 1351 having an acoustic pressure $P_1$, in this example a loudspeaker system. The loudspeaker system 1351 includes a loudspeaker housing 1352, an amplifier 1353, an active driver 1354, and a controller 1355. Two acoustic pressure reducers 1301*a*, 1301*b* are placed in series and each coupled to the loudspeaker system 1351. Each acoustic pressure reducer 1301*a*, 1301*b* has a housing 1302*a*, 1302*b*, respectively.

Specifically, in this example a first pressure reducer 1301*a* has a first interior aperture 1305*a* and a first exterior aperture 1310*a*. The first pressure reducer 1301*a* is acoustically coupled to the loudspeaker 1351 via a loudspeaker exterior aperture 1360 and the first interior aperture 1305*a*. A second pressure reducer 1301*b* has a second interior aperture 1305*b* and second exterior aperture 1310*b*. The second pressure reducer 1301*b* is acoustically coupled to the first pressure reducer 1301*a* via the second interior aperture 1305*b* and the first exterior aperture 1310*a*. The second pressure reducer 1301*b* is acoustically coupled to an external environment having an acoustic pressure $P_3$ via the second exterior aperture 1310*b*. Each of the loudspeaker exterior aperture 1360, the first interior aperture 1305*a*, the first exterior aperture 1310*a*, the second interior aperture 1305*b*, and the second exterior aperture 1310*b* present an acoustic impedance causing the acoustic pressure in the first pressure reducer 1301*a* to assume a value $P_2$ and causing the acoustic pressure in the second pressure reducer 1301*b* to assume a value $P_2'$.

An acoustic pressure sensor 1315 is disposed within the second acoustic pressure reducer 1301*b* and is configured to measure and communicate acoustic pressure data as previously described herein. In various other examples, the acoustic pressure sensor 1315 may instead be placed inside the first acoustic pressure reducer 1301*a* or an additional acoustic pressure sensor may be placed inside the first acoustic pressure reducer 1301*a* in addition to the acoustic pressure sensor 1315 shown inside the second acoustic pressure reducer 1301*b*. A first wire aperture 1364*a* and a second wire aperture 1364*b* are disposed along the first pressure reducer housing 1302*a* and the second pressure reducer housing 1302*b*, respectively, and configured to pass a wired connection 1358 from the second reducer 1301*b* through the first reducer 1301*a* and into the loudspeaker 1351. In some implementations, such as the example shown in FIG. 9, the one or more wire apertures 1364*a*, 1364*b* may instead pass the wired connection 1358 to an external enclosure located outside of the loudspeaker 1351. Placing two or more acoustic pressure reducers in series may, for example, allow for an additional degree of pressure reduction or filtering to be achieving without having to substantially modify an existing acoustic pressure reducer design.

Figure 14:
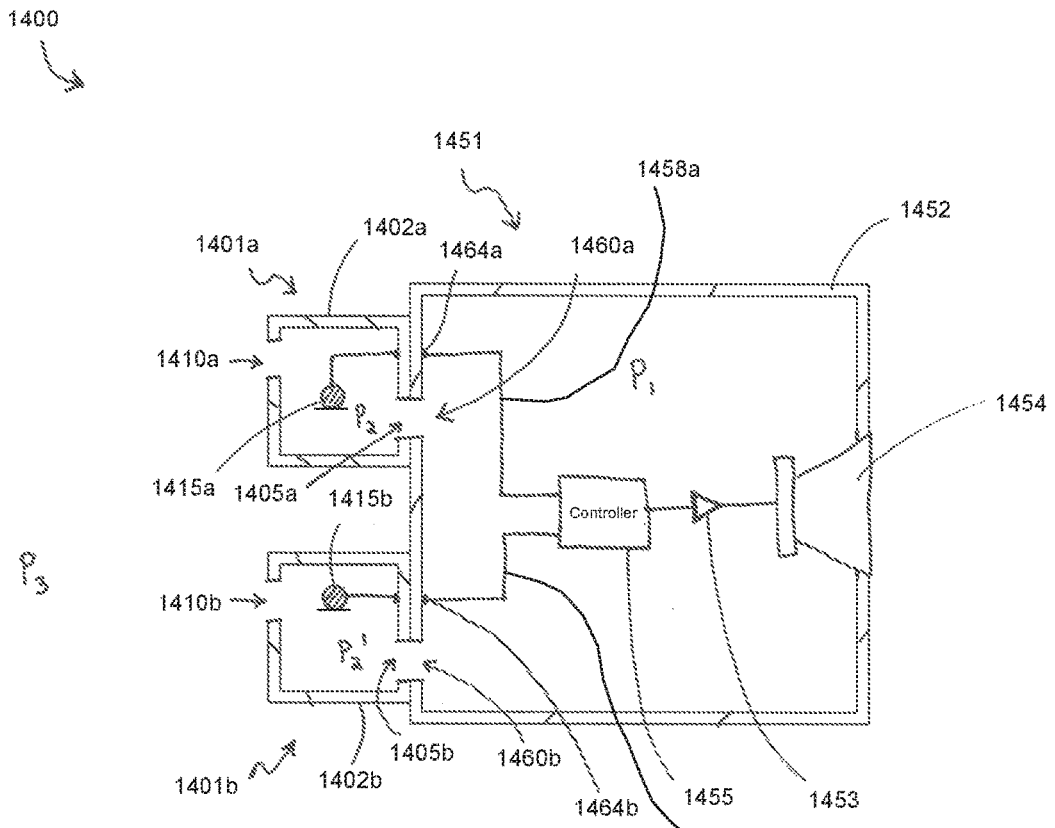
FIG. 14 is a cross-sectional diagram depicting an additional implementation of an acoustic pressure reducing system.

FIG. 14 is a cross-sectional view depicting another implementation of an acoustic pressure reducing system 1400. The acoustic pressure reducing system 1400 is coupled to an acoustic enclosure 1451 having an acoustic pressure $P_1$, in this example a loudspeaker system. The loudspeaker system 1451 includes a loudspeaker housing 1452, an amplifier 1453, an active driver 1454, and a controller 1455. Two acoustic pressure reducers 1401*a*, 1401*b* are placed in parallel and each coupled directly to the loudspeaker system 1451. Each pressure reducer 1401*a*, 1401*b* has a housing 1402*a*, 1402*b*, respectively.

Specifically, in this example a first pressure reducer 1401*a* has a first interior aperture 1405*a* and a first exterior aperture 1410*a*. The first pressure reducer 1401*a* is acoustically coupled to the loudspeaker 1451 via a first loudspeaker exterior aperture 1460*a* and the first interior aperture 1405*a*. A second pressure reducer 1401*b* has a second interior aperture 1405*b* and second exterior aperture 1410*b*. The second pressure reducer 1401*b* is acoustically coupled to the loudspeaker 1451 via the second interior aperture 1405*b* and the second loudspeaker exterior aperture 1460*b*. The first and second pressure reducers 1401*a*, 1401*b* are acoustically coupled to an external environment having an acoustic pressure $P_3$ via the first and second exterior apertures 1410*a*, 1410*b*, respectively. Each of the loudspeaker exterior apertures 1460*a*, 1460*b*, the first interior aperture 1405*a*, the first exterior aperture 1410*a*, the second interior aperture 1405*b*, and the second exterior aperture 1410*b* present an acoustic impedance causing the acoustic pressure in the first pressure reducer 1401*a* to assume a value $P_2$ and causing the acoustic pressure in the second pressure reducer 1401*b* to assume a value $P_2'$.

Two acoustic pressure sensors 1415*a*, 1415*b* are placed within the first acoustic pressure reducer 1401*a* and the second acoustic pressure reducer 1401*b*, respectively. Each acoustic pressure sensor 1415*a*, 1415*b* is configured to measure and communicate acoustic pressure data to a controller 1455. In various other examples, a single acoustic pressure sensor 1415*a* or 1415*b* may be placed inside the first acoustic pressure reducer 1401*a* or the second acoustic pressure reducer 1401*b* without including a second acoustic pressure sensor. A first wire aperture 1464*a* and a second wire aperture 1464*b* are disposed along the first pressure reducer housing 1402*a* and the second pressure reducer housing 1402*b*, respectively, and configured to pass a respective wired connection 1458*a*, 1458*b* from each respective pressure reducer 1401*a*, 1401*b* to the loudspeaker 1451. In some implementations, such as the example shown in FIG. 9, the one or more wire apertures 1464*a*, 1464*b* may instead pass each respective wired connection 1458*a*, 1458*b* to an external enclosure located outside of the loudspeaker 1451. Placing two or more acoustic pressure reducers in parallel with the acoustic enclosure 1451 may, for example, allow for an additional degree of pressure reduction or filtering to be achieving without having to substantially modify an existing acoustic pressure reducer design.

In the various examples and implementations discussed herein, the radius or cross-sectional area of each interior or exterior aperture may be designed to have any size necessary to achieve the desired acoustic impedance. For example, the radius or diagonal of an interior or exterior aperture is between 0.01 mm and 500 mm. Similarly, in the various examples and implementations discussed herein, the length of an acoustically-impeding element may be designed to have any size necessary to achieve the desired acoustic impedance. For example, the length of an acoustically-impeding element is between 0.01 mm and 500 mm. Similarly, in the various examples and implementations discussed herein, the volume enclosed by a pressure reducer housing may be designed to have any magnitude necessary to achieve the desired acoustic impedance. For example, the volume enclosed by the housing of a pressure reducer is between 0.01 cubic centimeters and 1000 cubic centimeters.

Though the elements of several views of the drawings herein may be shown and described as discrete elements in a block diagram and may be referred to as "circuitry," unless otherwise indicated, the elements may be implemented as one of, or a combination of, analog circuitry, digital circuitry, electromechanical circuitry, or one or more microprocessors executing software instructions. For example, the software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations may be expressed in terms of the calculation and application of coefficients. The equivalent of calculating and applying coefficients can be performed by other analog or digital signal processing techniques and are included within the scope of this disclosure. Unless otherwise indicated, audio signals may be encoded in either digital or analog form; conventional digital-to-analog or analog-to-digital converters may not be shown in the figures.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Having described above several aspects of at least one implementation, it is to be appreciated various alterations, modifications, and improvements will readily occur to those skilled in the art. Such alterations, modifications, and improvements are intended to be part of this disclosure and are intended to be within the scope of the description. Accordingly, the foregoing description and drawings are by way of example only, and the scope of the disclosure should be determined from proper construction of the appended claims, and their equivalents.

What is claimed is:

1. A system for monitoring acoustic pressure in an acoustic system, the system comprising:

a loudspeaker system comprising:

a controller configured to provide electrical signals to an amplifier configured to generate amplified signals based on the electrical signals;

an active driver disposed in an enclosure and coupled to the amplifier and to a loudspeaker, the active driver configured to be driven by the amplified signals to generate acoustic energy;

an acoustic pressure reducer comprising:

a housing, at least a portion of the housing abutting the enclosure; and a pressure sensor disposed within the housing and configured to measure an acoustic pressure and transmit pressure data to the controller, wherein the controller is configured to determine an acoustic pressure within the loudspeaker system based on a pressure reduction factor and the pressure data;

a first aperture acoustically coupling an interior volume of the housing to an interior volume of the enclosure; and a second aperture acoustically coupling the interior volume of the housing to atmosphere.

2. The system of claim 1, wherein the controller is further configured to calculate the pressure reduction factor based on a total acoustic impedance provided by the pressure reducer and the loudspeaker.

3. The system of claim 1, wherein the controller is further configured to adjust the electrical signals provided to the amplifier based on the acoustic pressure.

4. The system of claim 1, wherein the pressure sensor comprises a MEMS microphone.

5. The system of claim 1, further comprising a first acoustically-impeding element disposed through the first aperture and configured to provide acoustic impedance.

6. The system of claim 5, wherein the first acoustically-impeding element comprises one of a screen, a port, or a stiff diaphragm.

7. The system of claim 1, further comprising a second acoustically-impeding element disposed through the second aperture and configured to provide acoustic impedance.

8. The acoustic system of claim 1, wherein the housing has a volume of less than 20 cubic centimeters.

9. The acoustic system of claim 1, wherein the first aperture is less than 10 mm in radius.

10. A method monitoring and controlling acoustic pressure in an acoustic system, the method comprising:

receiving unattenuated acoustic energy via a first aperture in a housing of an acoustic pressure reducer;

attenuating the acoustic energy by providing an acoustic impedance, the acoustic impedance being provided by a first acoustically-impeding element disposed through the first aperture and a second aperture acoustically coupling an interior volume of the housing to atmosphere;

measuring an attenuated acoustic pressure of the attenuated acoustic energy via a pressure sensor disposed within the housing;

transmitting data representing the attenuated acoustic pressure to one or more controllers;

determining, by the one or more controllers, an unattenuated acoustic pressure of the unattenuated acoustic energy based on the data and a pressure reduction factor;

comparing, by the one or more controllers, the unattenuated acoustic pressure to a pressure tolerance of a loudspeaker; and adjusting, responsive to comparing the unattenuated acoustic pressure to the pressure tolerance, the power provided to the loudspeaker via the one or more controllers.

11. The method of claim 10, wherein the pressure sensor comprises a MEMS microphone.

12. The method of claim 10, wherein the first acoustically-impeding element comprises one of a screen, a port, or a stiff diaphragm.

13. The method of claim 10, wherein the acoustic pressure reducer further comprises a second acoustically-impeding element disposed through the second aperture and configured to provide acoustic impedance.

14. The method of claim 13, wherein the second acoustically-impeding element comprises one of a screen, a port, or a stiff diaphragm.

15. The method of claim 10, wherein the housing has a volume of less than 20 cubic centimeters.

16. The method of claim 10, wherein the interior aperture is less than 10 mm in radius.

17. A system for monitoring acoustic pressure in an acoustic system, the system comprising:

a loudspeaker system comprising:

a controller configured to provide electrical signals to an amplifier configured to generate amplified signals based on the electrical signals;

an active driver disposed in an enclosure and coupled to the amplifier, the active driver configured to be driven by the amplified signals to generate acoustic energy;

an acoustic pressure reducer comprising:

a housing, at least a portion of the housing abutting the enclosure; and a pressure sensor disposed within the housing and configured to measure an acoustic pressure and transmit pressure data to the controller, wherein the controller is configured to determine an acoustic pressure within the loudspeaker system based on a pressure reduction factor and the pressure data;

a first aperture acoustically coupling an interior volume of the housing to an interior volume of the enclosure; and a second aperture acoustically coupling the interior volume of the housing to atmosphere, the controller further configured to compare the acoustic pressure within the loudspeaker system to a pressure tolerance of the active driver; and adjust, responsive to comparing the acoustic pressure within the loudspeaker system to the pressure tolerance, the power provided to the active driver via the controller and amplifier.

* * * * *